US007198388B2

(12) United States Patent
Pilby

(10) Patent No.: US 7,198,388 B2
(45) Date of Patent: Apr. 3, 2007

(54) CURVED FLEXIBLE LIGHT CONTROL GRIDS WITH RIGID FRAMEWORK

(76) Inventor: Stephen E. Pilby, 9513-56 Avenue, Edmonton, Alberta (CA) T6E 0B2

( * ) Notice: Subject to any disclaimer, the term of this patent is extended or adjusted under 35 U.S.C. 154(b) by 253 days.

(21) Appl. No.: 10/829,903

(22) Filed: Apr. 21, 2004

(65) Prior Publication Data

US 2005/0237729 A1 Oct. 27, 2005

(51) Int. Cl.
*F21V 11/06* (2006.01)
*E04C 2/42* (2006.01)

(52) U.S. Cl. ..... 362/325; 362/354; 362/361; 52/664

(58) Field of Classification Search ..... 362/342, 362/354, 347, 325, 361; 52/664
See application file for complete search history.

(56) References Cited

U.S. PATENT DOCUMENTS 2,601,034 A * 6/1952 Lee ..... 362/354
2,837,632 A * 6/1958 Lipscomb ..... 362/342
3,024,355 A * 3/1962 Lipscomb ..... 362/342
3,381,124 A * 4/1968 Eisenberg ..... 362/354
3,628,007 A * 12/1971 Rosenberg ..... 362/342
3,763,618 A 10/1973 Bennett et al.
4,045,931 A 9/1977 Becker
4,083,153 A 4/1978 Sumpter
4,471,596 A * 9/1984 Deaton et al. ..... 362/354
5,287,908 A 2/1994 Hoffmann et al.
5,556,186 A * 9/1996 Pilby ..... 362/342
5,558,925 A 9/1996 Fritzman
5,701,939 A * 12/1997 Pinto et al. ..... 160/84.01
D464,737 S * 10/2002 Gulbrandsen et al. ..... D25/58

OTHER PUBLICATIONS

Stephen E. Pilby, Lighttex Web Site printout.
Stephen E. Pilby, Photographs from IFRA Newsplex installation.

* cited by examiner

*Primary Examiner*—Sandra O'Shea
*Assistant Examiner*—Ismael Negron
(74) *Attorney, Agent, or Firm*—Robert J. Lauson, Esq.; Lauson & Associates

(57) ABSTRACT

Light control grids in curved ceilings or walls include an assembly of flexible, spaced-apart sets of fabric strips that intersect and interlock, one of the sets of strips being substantially curved along its length and/or of varying length. The grids are supported by a modular rigid framework that maintains the strips taut, the frames being substantially curved corresponding to the curved strips and/or strips of varying length. A number of connectors hold the frames together and are used to attach the assembly to the building, and a number of releasable fasteners moveably retained by the frames attach the grids to the frames.

17 Claims, 7 Drawing Sheets
(1 of 7 Drawing Sheet(s) Filed in Color)

CURVED FLEXIBLE LIGHT CONTROL GRIDS WITH RIGID FRAMEWORK

BACKGROUND OF THE INVENTION

1. Background of the Invention

This invention relates to curved dividers that diffuse light for buildings.

2. Description of the Related Art

Applicant's Lighttools® Soft Egg Crates® light control grids as described in Pilby U.S. Pat. No. 5,556,186 have become standard equipment in the film production industry for blocking and shaping soft light, i.e., maintaining desirable large light source characteristics while at the same time controlling extraneous spread of side light. These light control grids are fabricated from intersecting and interlocking strips of fabric slotted in a complimentary manner, the resulting assembly completely collapsible to fit into a lightweight package about the size of a shoe box. Previously photographers utilized rigid grids or honeycombs to guide light that were difficult to store and use, and expensive.

A similar situation existed in the field of light control for open spaces such as inside commercial buildings, where it was desired to have large grids form drop ceilings or walls while still allowing light to pass into a room. Such grids were generally fabricated of traditional materials (e.g. wood or plastic) and were inflexible and heavy. This made transportation to the site and installation difficult, and thus use of such grids was limited. In November, 2002 Applicant introduced its Lighttex™ space and light solutions product for buildings at the Ifra Newsplex newsroom at the University of South Carolina. That prototype installation included large sheets of the patented, fabric Soft Egg Crates® light control grids, installed with tensioned cables and other conventional hardware to maintain tautness and hold the grids in place.

Although Applicant's installation at the University of South Carolina received critical acclaim, that process was awkward and labor intensive indicating that further work needed to be done developing the Lighttex™ product. Applicant also desired to enhance the aesthetic appeal of these architectural applications of its Soft Egg Crates® product to the greatest extent possible. Accordingly, in recent months Applicant created new curved and modular panels of the Soft Egg Crates® product and new attaching hardware. The curved panels add to the aesthetic appeal of the product, while the modular configuration and new attaching hardware makes it quick and easy to install in and around spaces in commercial or other buildings.

BRIEF SUMMARY OF THE INVENTION

Light control in curved ceilings, walls or the like for a building includes a grid having a large number of light channels formed from intersecting and interlocking sets of flexible strips spaced apart, with each strip intersecting a number of the strips of the other set. At least one of the sets of strips includes a number of strips that are substantially curved along the length of the strips and/or the lengths of the strips may vary. The strips are pulled taut and attached to the structure of a building to form the curved wall or ceiling or the like.

Preferably the strips of the first set include pairs of slots extending transversely to the long direction of the strips, each slot of the pairs intersecting a different edge of the strips from the other slot. Preferably the strips of the second set have openings for receiving the strips of the first set between the pair of slots. Preferably the strips are of a fabric material and may include reflecting material on the edges. The preferred shape and size of each grid (or modular, framed panel as described below) is generally rectangular and not more than about ten feet wide in either direction, although varying sizes and irregular shapes can be constructed as well.

The light control grid further includes a rigid framework formed by rigid frames connected together and attached to the grids to maintain the strips taut, at least one of the rigid frames being substantially curved along the long direction of the frames corresponding to the curved strips and/or the varying lengths of the strips. Preferably, the light control grid includes a number of connectors to attach the frames together, and a number of releasable fasteners attaching the perimeter of the grid to the rigid frames and the frames retaining the fasteners. Preferably the rigid frames are slotted such that the fasteners are moveable along the length of the frames, the frames being elongate aluminum extrusions formed to appropriate curvatures.

The rigid framework is typically configured to accept multiple grids to create an assembly of light control grids. Preferably there are connecters to attach together the framework of light control grids, the connectors also having means to attach the assembly to structure of the building, e.g. hung by a plurality of wires. The resulting curved ceilings and walls that diffuse light while dividing a room are aesthetically pleasing and highly functional, and easy to install and inexpensive. The fasteners being moveable along the frames allows portions of the installed grids to be collapsed to gain convenient access for maintenance behind the grids as desired.

BRIEF DESCRIPTION OF THE SEVERAL VIEWS OF THE DRAWINGS

The patent or application file contains at least one drawing executed in color. Copies of this patent or patent application publication with color drawing(s) will be provided by the Office upon request and payment of the necessary fee.

There will now be described preferred embodiments of the present invention, with reference to the drawings, by way of illustration, in which numerals 10 and above denote elements and in which:

FIG. 2(*b*) is a perspective view of a portion of a partially-collapsed light control grid;

FIG. 3(*b*) is a side view of a straight type of strip used to make the grids;

FIG. 4(*b*) is a side view of a straight frame;

DESCRIPTION OF THE PREFERRED EMBODIMENT(S)

Figure 1:
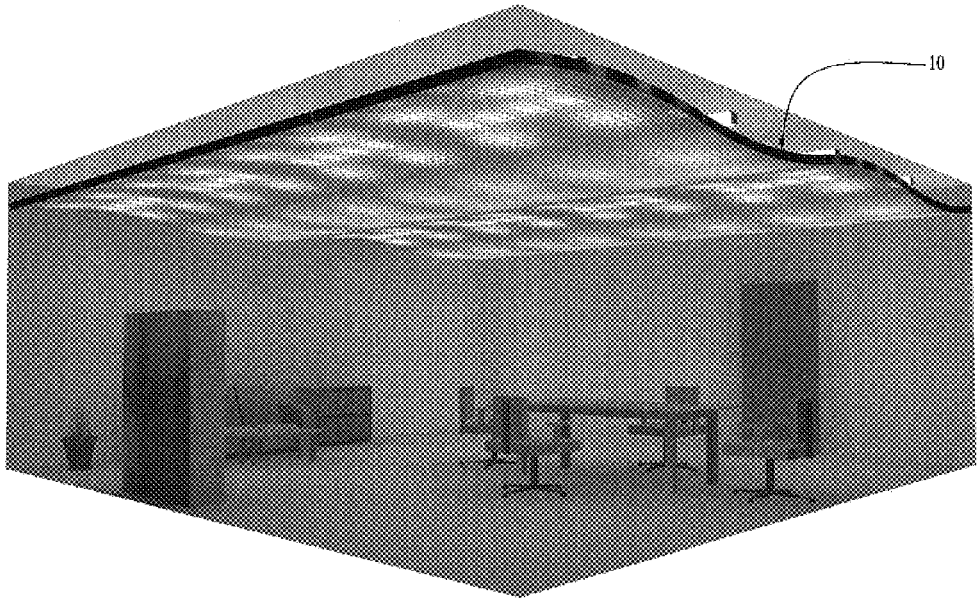
FIG. 1 is a perspective, photograph-like image of the assembly of curved, modular light control grids of a preferred embodiment of the present invention installed as a suspended ceiling inside a building.

Referring to FIG. 1, shown is a curved ceiling assembly 10 of the preferred embodiment of the present invention. The curved ceiling 10 is constructed of a number of light control grids 13 assembled together and suspended from the structure of the building. The curved ceiling 10 is aesthetically pleasing in obscuring in part the upper portion of the room and functional in diffusing the light from the light fixtures.

Figure 2A:
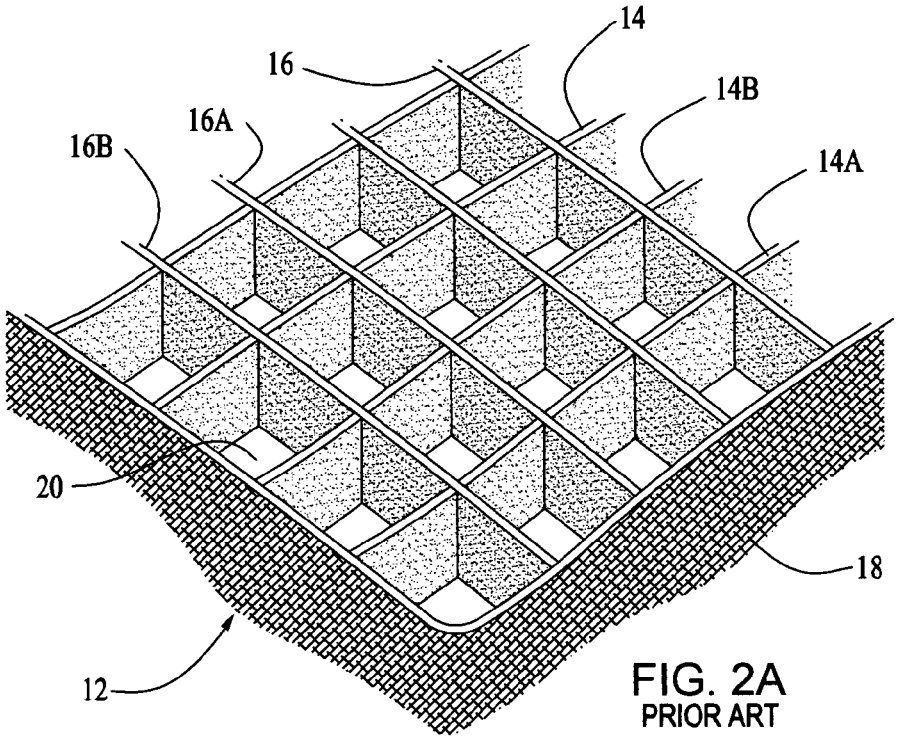
FIG. 2A PRIOR ART
FIG. 2(*a*) is a close up perspective view of a portion of an individual light control grid having intersecting and interlocking flexible strips and perimeter.
Figure 2B:
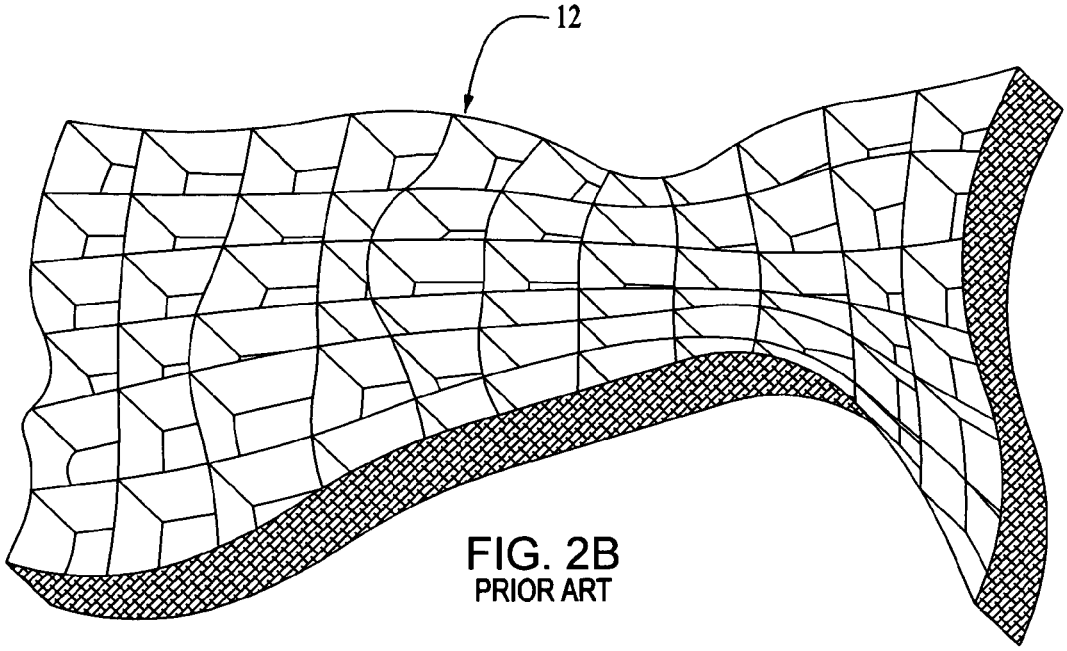
FIG. 2B PRIOR ART

FIGS. 2(*a*), (*b*) show a portion of the light control grid 12 and its collapsibility from the prior Pilby U.S. Pat. No. 5,556,186. The light control grid 12 is formed from a plurality of flexible, fabric strips 14, 16 bounded on the perimeter of the grid by a flexible strip 18. The fabric strips 14, 16 form connected open ended laterally bound light channels 20. Reflecting material may be placed on inside facing edges 14*a*, 14*b*, 16*a*, 16*b* of strips 14. 16 to guide light from the light source(s) or depending upon the lighting objectives for the area. Referring to FIG. 2(*b*). the flexible nature of the strips 14. 16 allows the grid to collapse for ease of carrying. For a six (6) foot by six (6) foot rectangular, fabric grid, the collapsed volume is less than that of a conventional shoe box. and the weight between about five (5) and six (6) pounds.

Figure 3A:
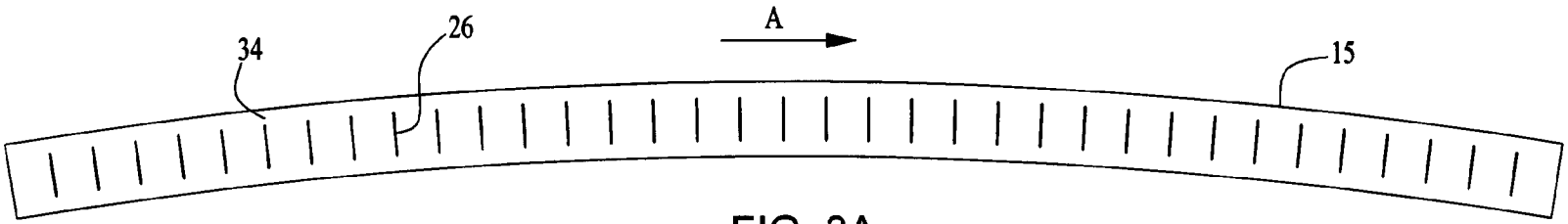
FIG. 3(*a*) is a side view of a curved type of strip used to make the grids of FIG. 1.
Figure 3B:
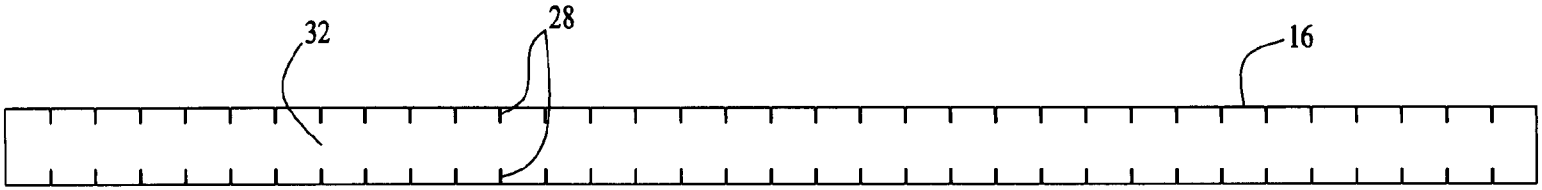

Referring to FIGS. 3(*a*) and (*b*) and 5, a control grid 13 for a curved ceiling 10 is preferably formed from plural, intersecting fabric strips which interlock to define light channels 21 between them. The strips 15, 16 are formed in first and second sets, strips in each set being approximately equal spaced between others in the set, and each strip in each set intersecting strips of the other set. The strips 15 of the first set (FIG. 3(*a*)) include slots 26 extending transversely to the long direction (Arrow A) of the strips 15 and the strips 16 of the second set (FIG. 3(*b*)) include complimentary slots 28 for receiving material (shown at 32) of the strips 15 of the first set adjacent the slots 26. The strips 16 are inserted into the strips 15 such that the material at 32 of the strips 15 lies within the slots 28 and the material at 34 in the strips 16 lies within the slots 26.

Figure 4A:
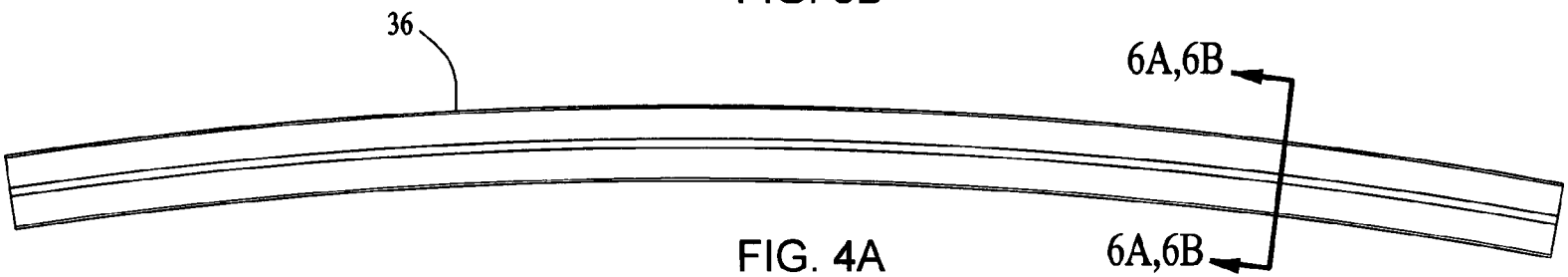
FIG. 4(*a*) is a side view of a curved frame.
Figure 4B:
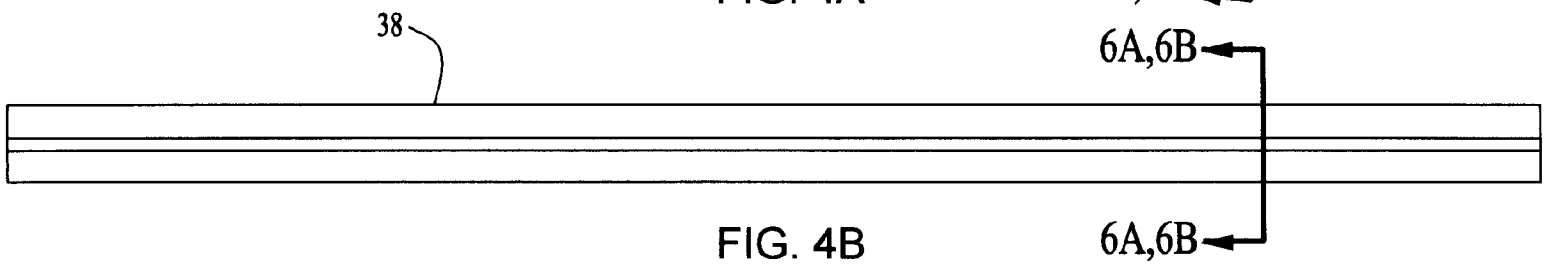
Figure 5:
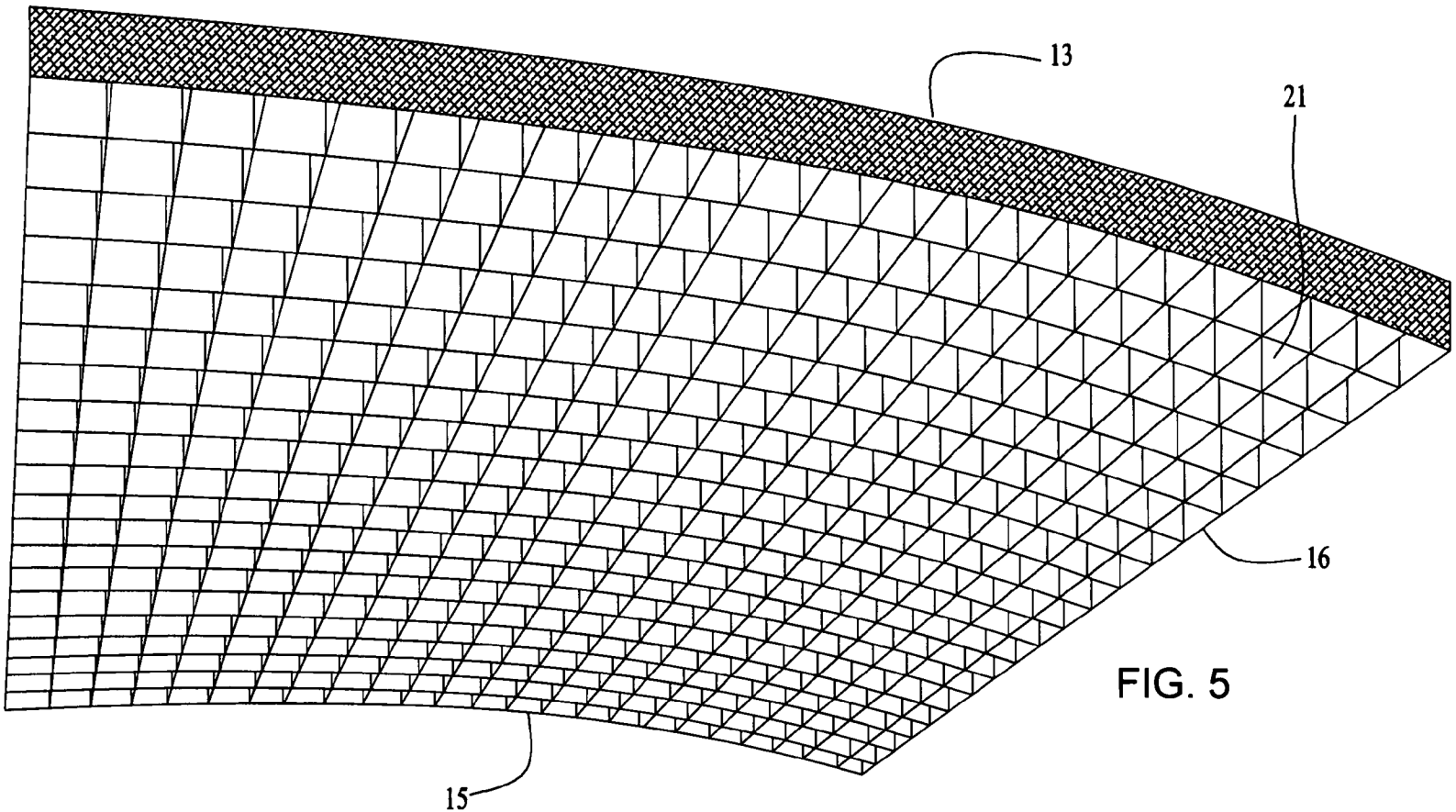
FIG. 5 is a perspective view of a single curved grid.

Now referring to FIGS. 3, 4, shown in FIG. 3(*a*) is a gently curved strip 15 on a radius of approximately 217.6 inches, the slots 26 transverse to the long direction (Arrow A) of the strip. The other strip 16 (FIG. 4(*b*)) is generally straight. Alternatively, although not shown, the strip 15 could be generally straight and the other strip 16 on a large radius with the slots 28 extending transversely to the curved edges of the curved strip 16. Shown in FIG. 5 is the resulting, curved grid 13 when the strips 15, 16 are pulled in a taut condition.

Figure 6A:
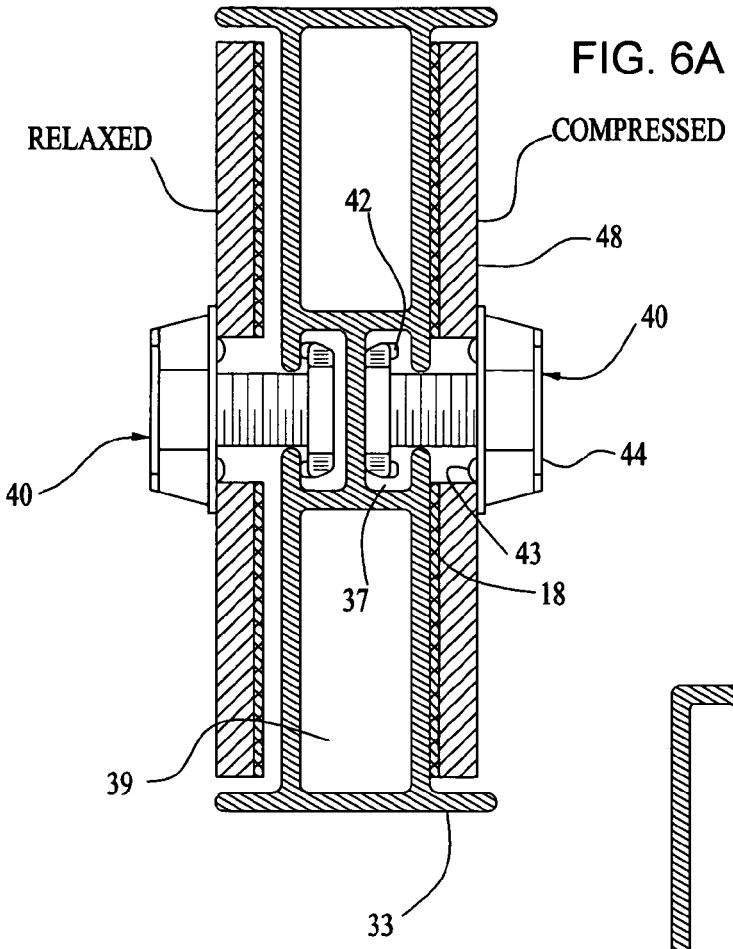
FIGS. 6(*a*), (*b*) are cross-section views of interior and perimeter frames and associated hardware attached to the perimeter(s) of one or more grids.
Figure 6B:
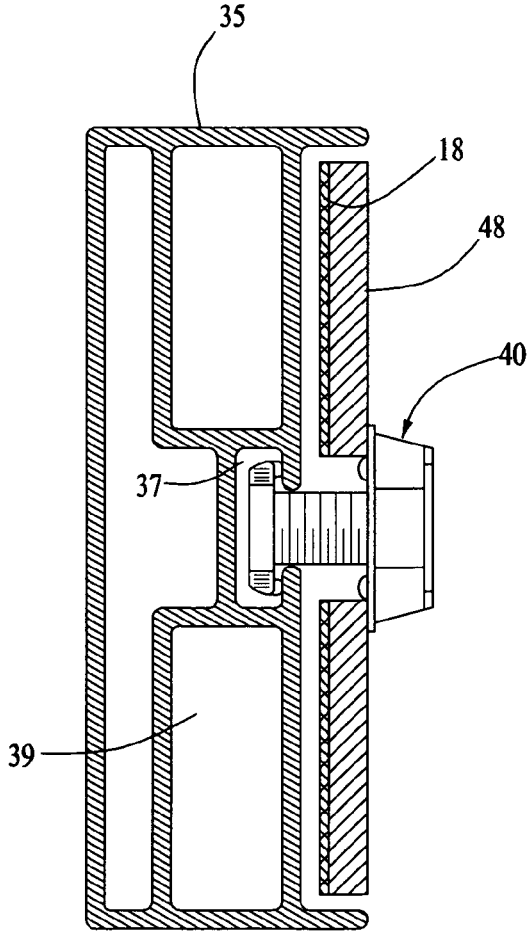

Referring to FIG. 4(*a*), shown is a formed, aluminum extruded frame 36 with the curve corresponding to the curve of the strip 15. FIG. 4(*b*) shows a straight aluminum extrusion frame 38. FIGS. 6(*a*) and (*b*)show the cross-sections of interior frame 33 and exterior 35 frames, including a T-slotted area 37. Note the interior frame 33 is configured to accept the perimeters 18 of a pair of the light control grids 13 while the exterior frame 35 accepts a light control grid 13 perimeter 18 only on one side.

Also shown in FIGS. 6(*a*)and (*b*)is other attaching hardware including plastic polyvinyl chloride (PVC) plates 48 and ¼ turn plastic fasteners 40. There is a small plate 48 for each fastener 40, and the plate 48 is about an inch long to fit inside the grid 13 light channel 21 against the perimeter 18 side. The fastener 40 is shown in the right part of FIG. 6(*a*)in a "compressed" condition while being installed, and shown in the left part of that same figure in a "relaxed" installed condition. The fastener 40 includes a pair of raised dimples 42 which assist in enabling sliding of the fastener 40 (while in the relaxed condition) through the T-slotted area 37 of the frames 36 or 38, interior 33 or exterior 35 frames. The other set of raised dimples 43 on the underside of each of the fastener 40 heads help secure the fasteners 40 into the locked position. The shaft of the fastener 40 may be slightly tapered (not shown) with the larger diameter being inside the frame in the T-slotted area 37.

Figure 7A:
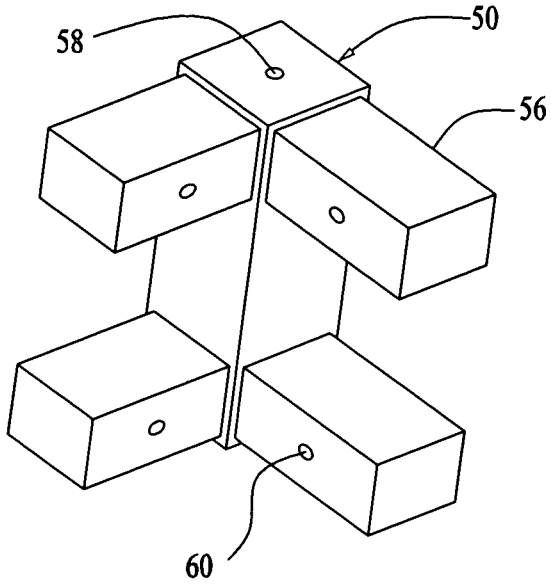
FIGS. 7(*a*)–(*c*) are perspective views of three (3) connectors for attaching together the framework supporting the flexible grids and providing attachment means to the building; and, FIGS. 8(*a*)–(*c*) are side elevation views of frame structures for various rounded edge wall or ceiling panels.
Figure 7B:
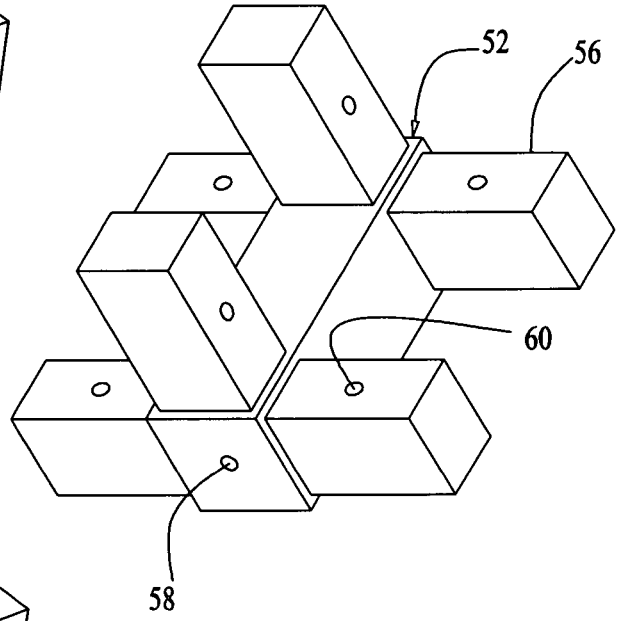
Figure 7C:
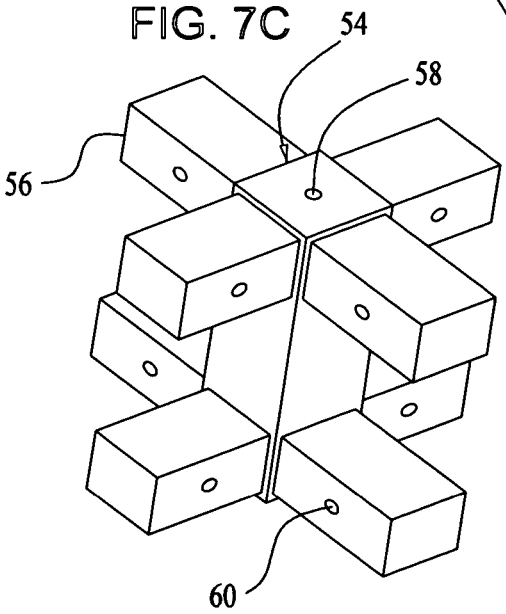

Next referring to FIGS. 7 (*a*)–(*c*), shown are a corner connector 50, a side connector 52 and an inside connector 54, for attaching the frames together. The corner connectors 50 are used at the outer corners of a curved ceiling assembly 10 of light control grids 13 and framework, while the side connectors 52 are used to secure frames together along the outside perimeter (except the corners) and the inside connectors 54 connect frames together not on the perimeter of the assembly 10.

The connector legs 56, several of which are found on each of the connectors 50, 52 and 54, are sized with a small clearance to fit inside the frame opening 39 (see FIGS. 6(*a*), (*b*)at the ends of the frames. The holes 60 align with complimentary holes in the frames (not shown) and receive a pin (not shown) to secure the connectors to the frames, thereby securing the frames together. The holes 58 are to receive a wire (not shown), to attach the framework including the frames and connectors 50, 52, 54 and the light control grids 12 to structure of a building. Obviously there are many other acceptable ways of assembling the frames and securing the assembly to the building.

Figure 8A:
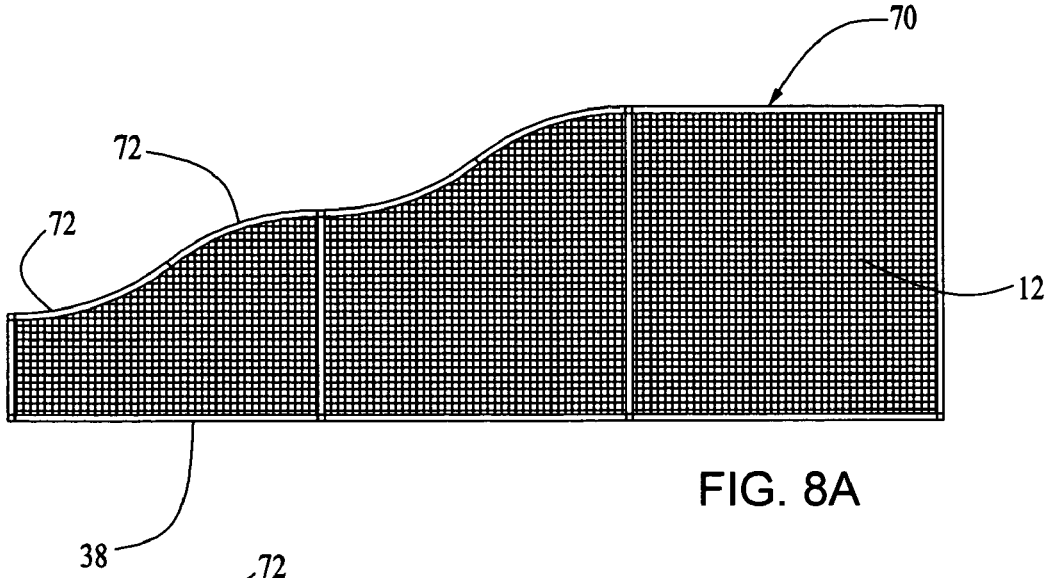
Figure 8B:
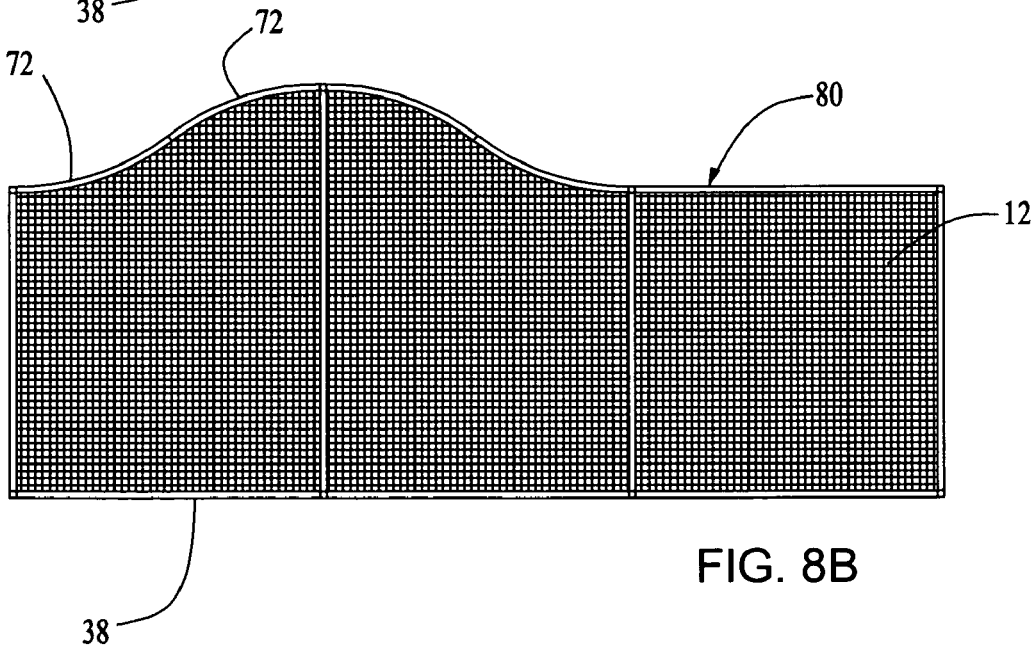
Figure 8C:
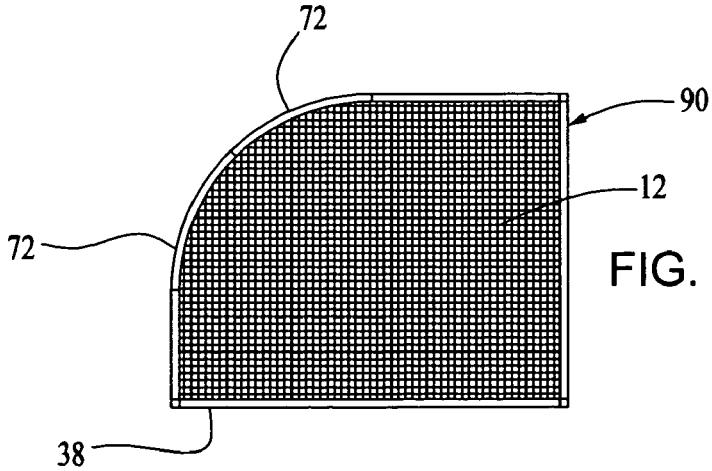

Finally, FIGS. 8(*a*)–(*c*) shows three additional, possible irregular-shaped configurations for walls constructed of fabric grids 12, namely a wave panel 70, and arch panel 80 and a round corner panel 90. Note in these wall panels 70, 80 and 90 as shown the frames 38, 72 and grid 12 are planer or flat in the plane of the grid 12, and merely the frames 72 are rounded. These irregular shaped wall panels are accomplished by varying the length of the strips 14, 16 in the grid 12. Such panels could additionally utilize the curved strips 15 and curved frames 36 described above to make compound-contoured panels (not shown).

Having described the basic structure of the preferred embodiments of the present invention, it is now possible to discuss its operation, function and use. The first step in installing the curved ceiling (or wall) assembly 10 is selecting the light control grids 13 and framework for a portion of a building. Then the light control grids are assembled using the curved 15 and straight 16 strips, of varying lengths if desired. A computer program may be helpful in determining the appropriate curvatures/lengths for the strips 15, 16.

Next appropriate frames (with the correct curvature and configuration) and grids are assembled, the frames attached together with the appropriate connectors and the grids 13 pulled taut and attached to the frames with the fasteners 40. Approximately up to forty (40) pounds of tension is applied to two sides of the grids 13 in pulling them taut and attaching them to the frames. Further connectors are used to connect the frames together as the curved ceilings (or walls) are installed and attached to the building.

As necessary, selected fasteners 40 may be released and one side of the grid 13 pulled away from the frames, and typically the two adjacent sides slid along their respective frames. This allows the grid 13 or portions of it and to be collapsed providing convenient access for maintenance behind the installed ceiling 10. When access behind the grids 13 is no longer needed, then the fasteners 40 are slid back along the frames pulling the grids 13 taut and the other fasteners reinstalled, and all these fastener 40 heads pushed down and turned a quarter turn to lock to securely hold the grids 13 again.

A person skilled in the art could make immaterial modifications to the invention described and claimed in this patent without departing from the essence of the invention.

What is claimed is:

1. A light control grid for forming a curved ceiling or wall to a building comprising:

a grid having a multiplicity of connected, open ended, laterally bound light channels; the grid being formed from plural intersecting and interlocking flaccid strips in first and second sets; the strips in each set being spaced apart from each other, and each strip in each set intersecting a plurality of the strips of the other set; at least a plurality of the strips of one of the sets being substantially curved along the long direction of the strips; and, a rigid framework formed by rigid frames detachably connected together and attached to the perimeter of the grid to support the grid in tautly extended manner, at least one of the rigid frames being substantially curved along the long direction of the frames corresponding to the curved strips.

2. The light control grid of claim 1 wherein the grid is generally rectangular and not more than about ten feet wide in either direction.

3. The light control grid of claim 1 further comprising a plurality of connectors to attach the frames together.

4. The light control grid of claim 1 wherein at least one of the rigid frames is attached to an additional light control grid thereby creating an assembly of light control grids.

5. The light control grid of claim 4 further comprising means for attaching the assembly of light control grids to a structure of the building.

6. The light control grid of claim 4 wherein the assembly of light control grids are hung from the building by a plurality of wires.

7. The light control grid of claim 1 wherein the strips of the first set including pairs of first slots extending transversely to the long direction of the strips, each slot of the pairs of slots intersecting a different edge of the strips from the other of each pair of first slots, and the strips of the second set including complimentary second slots forming openings for receiving material of the strips of the first set between each pair of first slots.

8. The light control grid of claim 7 wherein the strips are of a fabric material.

9. The light control grid of claim 7 wherein the strips in each set are substantially parallel to each other.

10. The light control grid of claim 7 further including reflecting material on edges of strips forming the grid.

11. The light control grid of claim 1 further comprising a plurality of releasable fasteners attaching the grid to the rigid frames and the fasteners being retained by the frames.

12. The light control grid of claim 11 wherein the frames are slotted such that the fasteners are moveable along the length of the frames whereby at least a plurality of the intersecting and interlocking flaccid strips are collapsible if desired while installed in the rigid framework.

13. The light control grid of claim 12 wherein the rigid frames are elongate aluminum extrusions formed to an appropriate curvature.

14. A light control grid for dividing a room along a curved path in a building comprising:

a grid being formed from plural intersecting and interlocking flaccid strips in first and second sets; the strips in each set being spaced apart from each other, and each strip in each set intersecting a plurality of the strips of the other set, at least a plurality of the strips of one of the sets being substantially curved along the long direction of the strips;

wherein the strips of the first set including pairs of first slots extending transversely to the long direction of the strips, each slot of the pairs of slots intersecting a different edge of the strips from the other of each pair of first slots, and the strips of the second set including complimentary slots forming openings for receiving material of the strips of the first set between each pair of first slots; and, wherein the strips are of a fabric material; wherein the grid is extended and pulled taut from a collapsed condition by a reconfigurable framework of detachable mid frame members and attached to the building to form a curved wall, ceiling or the like through which light is diffused.

15. The light control grid of claim 14 wherein the rigid framework is attached to the grid to maintain the strips taut; the framework being formed by rigid frames connected together and attached to the grid, at least one of the rigid frames being substantially curved along the long direction of the frames corresponding to the curved strips; further comprising a plurality of connectors to attach the flames together; further comprising a plurality of releasable fasteners attaching the grid to the rigid frames; wherein at least one of the rigid frames is attached to a second light control grid thereby creating an assembly of light control grids; and, means to attach the assembly of fight control grids to the building.

16. The light control grid of claim 15 further comprising a plurality of wires to hang the assembly of light control grids from the building.

17. A light control grid for dividing a room along a curved path in a building comprising:

a grid being formed from plural intersecting and interlocking flaccid strips in first and second sets; the strips in each set being spaced apart from each other, and each strip in each set intersecting a plurality of the strips of the other set, wherein the strips of the first set including pairs of first slots extending transversely to the long direction of the strips, each slot of the pairs of slots intersecting a different edge of the strips from the other of each pair of first slots, and the strips of the second set including complimentary slots forming openings for receiving material of the strips of the first set between each pair of first slots; wherein the strips are of a fabric material and a plurality of the strips in at least one of the sets are of varying lengths; and further comprising a rigid framework attached to the grid to extend and maintain the strips taut, the framework being formed by rigid frames detachably connected together and attached to the grid by a plurality of releasable fasteners; wherein the frames are slotted such that the fastened are moveable along the length of the frames whereby at least a plurality of the intersecting and interlocking flaccid strips are collapsible if desired while installed in the rigid framework; and wherein at least one of the rigid frames is substantially curved corresponding to the strips being of varying lengths.

* * * * *